US008919441B2

(12) United States Patent
Parlin

(10) Patent No.: US 8,919,441 B2
(45) Date of Patent: Dec. 30, 2014

(54) METHOD OF INTERSECTING A FIRST WELL BORE BY A SECOND WELL BORE

(75) Inventor: Joseph DeWitt Parlin, Plano, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 14/241,346

(22) PCT Filed: Jul. 3, 2012

(86) PCT No.: PCT/US2012/045418

§ 371 (c)(1), (2), (4) Date: Feb. 26, 2014

(87) PCT Pub. No.: WO2014/007809

PCT Pub. Date: Jan. 9, 2014

(65) Prior Publication Data

US 2014/0216744 A1 Aug. 7, 2014

(51) Int. Cl.

| | |
|---|---|
| ***E21B 33/13*** | (2006.01) |
| ***E21B 23/12*** | (2006.01) |
| ***E21B 7/08*** | (2006.01) |
| ***E21B 29/06*** | (2006.01) |
| ***E21B 7/04*** | (2006.01) |
| ***E21B 43/17*** | (2006.01) |
| ***E21B 43/30*** | (2006.01) |
| ***E21B 7/06*** | (2006.01) |
| ***E21B 33/12*** | (2006.01) |

(52) U.S. Cl.

CPC . *E21B 7/04* (2013.01); *E21B 29/06* (2013.01); *E21B 43/17* (2013.01); *E21B 43/30* (2013.01); *E21B 43/305* (2013.01); *E21B 7/061* (2013.01); *E21B 33/1204* (2013.01)

USPC ..... 166/285; 166/117.6; 166/298; 166/363

(58) Field of Classification Search

CPC ..... E21B 7/061; E21B 29/06; E21B 35/00

USPC ..... 166/285, 298, 117.6, 255.1, 363, 364; 175/61, 75

See application file for complete search history.

(56) References Cited

U.S. PATENT DOCUMENTS 2,131,849 A * 10/1938 Tolson ..... 175/45
3,282,355 A * 11/1966 Henderson ..... 175/61

(Continued)

OTHER PUBLICATIONS

International Search Report and Written Opinion of the International Searching Authority of International Application No. PCT/US2012/045418 issued on Mar. 21, 2013; 12 pages.

(Continued)

*Primary Examiner* — Jennifer H Gay

(74) *Attorney, Agent, or Firm* — Alan Bryson; Fish & Richardson P.C.

(57) ABSTRACT

A method and system for intersecting a first, cased well bore, includes forming a second well bore that extends to a region of the first, cased well bore to be intersected. A mill guiding device is positioned in the second well bore and a milling assembly is inserted into the second well bore. The milling assembly is guided along the mill guiding device and contacts an upper external shoulder of a casing coupling of a casing in the first, cased well bore. The mill preferentially removes material from a convex portion of the casing above and adjacent to the upper external shoulder the casing coupling; and removes material from the casing coupling and the adjacent casing until the first, cased well bore and the second well bore are fluidly connected.

20 Claims, 15 Drawing Sheets

(56) References Cited

U.S. PATENT DOCUMENTS

| | | | | | |
|---|---|---|---|---|---|
| 3,285,350 | A | * | 11/1966 | Henderson | 340/853.5 |
| 3,313,361 | A | * | 4/1967 | McCullough | 175/61 |
| 3,461,964 | A | | 8/1969 | Venghiattis | |
| 3,643,741 | A | * | 2/1972 | Miranda | 166/295 |
| 4,220,213 | A | | 9/1980 | Hamilton | |
| 4,224,989 | A | * | 9/1980 | Blount | 166/400 |
| 4,227,582 | A | | 10/1980 | Price | |
| 4,282,940 | A | | 8/1981 | Salisbury et al. | |
| 4,436,154 | A | | 3/1984 | Vann et al. | |
| 4,458,767 | A | * | 7/1984 | Hoehn, Jr. | 175/61 |
| 4,739,843 | A | | 4/1988 | Burton | |
| 4,981,177 | A | | 1/1991 | Carmody et al. | |
| 5,064,006 | A | * | 11/1991 | Waters et al. | 175/45 |
| 5,103,920 | A | * | 4/1992 | Patton | 175/45 |
| 5,138,877 | A | * | 8/1992 | Desbrandes | 73/152.24 |
| 5,230,387 | A | * | 7/1993 | Waters et al. | 175/45 |
| 5,341,873 | A | * | 8/1994 | Carter et al. | 166/117.5 |
| 5,358,050 | A | * | 10/1994 | Schmidt | 166/294 |
| 5,462,120 | A | | 10/1995 | Gondouin | |
| 5,778,980 | A | | 7/1998 | Comeau et al. | |
| 6,105,675 | A | * | 8/2000 | Buytaert et al. | 166/298 |
| 6,135,206 | A | | 10/2000 | Gano et al. | |
| 6,199,633 | B1 | * | 3/2001 | Longbottom | 166/242.6 |
| 6,360,821 | B1 | * | 3/2002 | Braddick | 166/117.6 |
| 6,880,646 | B2 | | 4/2005 | Batarseh | |
| 6,888,097 | B2 | | 5/2005 | Batarseh | |
| 6,997,262 | B2 | | 2/2006 | Palmer et al. | |
| 7,086,484 | B2 | | 8/2006 | Smith, Jr. | |
| 7,264,060 | B2 | | 9/2007 | Wills | |
| 7,487,834 | B2 | | 2/2009 | Reed et al. | |
| 7,493,951 | B1 | | 2/2009 | Kravits et al. | |
| 7,703,524 | B2 | | 4/2010 | Parlin | |
| 7,866,388 | B2 | | 1/2011 | Bravo | |
| 7,938,175 | B2 | | 5/2011 | Skinner et al. | |
| 2005/0051326 | A1 | | 3/2005 | Toothman, Jr. et al. | |
| 2005/0241834 | A1 | | 11/2005 | McGlothen et al. | |
| 2006/0266521 | A1 | | 11/2006 | Pratt et al. | |
| 2008/0060800 | A1 | | 3/2008 | Zupanick | |
| 2008/0185148 | A1 | | 8/2008 | Carter et al. | |
| 2010/0294478 | A1 | | 11/2010 | Guidry et al. | |
| 2010/0326659 | A1 | | 12/2010 | Schultz et al. | |
| 2010/0326665 | A1 | | 12/2010 | Redlinger et al. | |
| 2011/0005755 | A1 | | 1/2011 | Dietz et al. | |
| 2011/0290501 | A1 | | 12/2011 | Duncan et al. | |
| 2012/0230151 | A1 | * | 9/2012 | Almaguer | 367/86 |
| 2013/0037272 | A1 | * | 2/2013 | Dale et al. | 166/363 |
| 2013/0118809 | A1 | * | 5/2013 | Veeningen | 175/45 |
| 2013/0319693 | A1 | * | 12/2013 | Sponchia et al. | 166/384 |
| 2014/0174740 | A1 | * | 6/2014 | Parlin | 166/292 |
| 2014/0216744 | A1 | * | 8/2014 | Parlin | 166/285 |

OTHER PUBLICATIONS

Halliburton, "MillRite® Milled Exit Multilateral System," H03576, Apr. 2010, 2 pages.

* cited by examiner

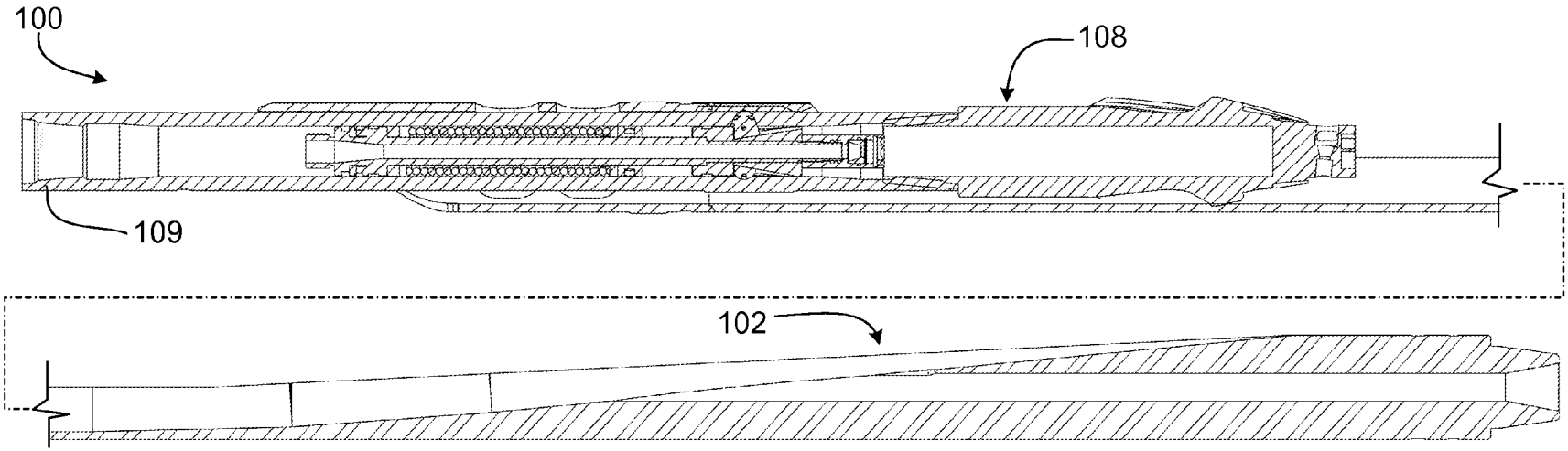
FIG. 4A
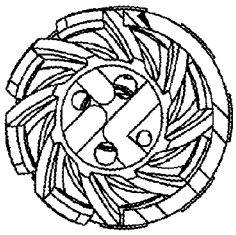
FIG. 4C
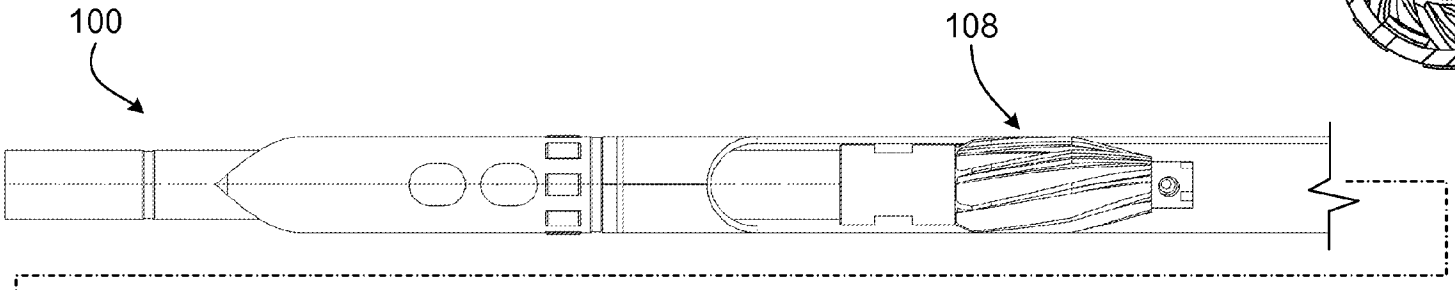
FIG. 4B
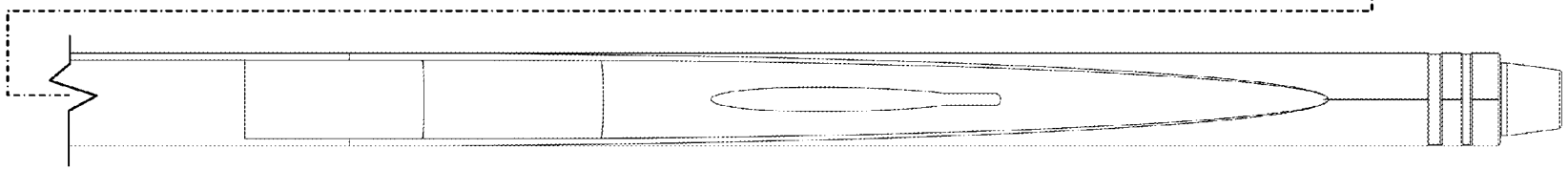

METHOD OF INTERSECTING A FIRST WELL BORE BY A SECOND WELL BORE

CLAIM OF PRIORITY

This application is a U.S. National Stage of PCT/US2012/045418 filed on Jul. 3, 2012.

TECHNICAL FIELD

This disclosure relates to a method of intersecting a first well bore by a second well bore and plugging methods for the first well bore.

BACKGROUND

Well bores can be drilled into the earth to tap into underground reservoirs of oil or gas. Such well bores can be lined with a casing (e.g., a metal casing) to add structural stability to the well bores. Well bores are typically abandoned after use. In some cases, a well bore may be abandoned and closed after the volume of oil or gas produced by the well drops below suitably economical levels. Alternatively, in some cases, a well bore is abandoned and closed as a result of a loss of control (blowout) in a well bore. Different regulatory bodies have different requirements for such abandoning operations. Some regulatory bodies require that the abandoned well bore be plugged (e.g., with cement plugs).

SUMMARY

The present disclosure relates methods and systems for intersecting well bores. In a general aspect, a method for intersecting a first, cased well bore includes drilling a second well bore that has a distal end proximal to the first, cased well bore to be intersected, disposing a mill guiding device in the second well bore near a casing of the first, cased well bore, the mill guiding device being configured to direct a mill of a milling assembly away from a central axis of the second well bore and towards the first, cased well bore, inserting the milling assembly into the second well bore, operating the mill of the mill assembly and guiding the milling assembly along the mill guide and into the casing of the first well bore, and removing material from the casing of the first well bore until the first, cased well bore and the second well bore are fluidly connected.

In another general aspect, a method for intersecting a first, cased well bore includes forming a second well bore that extends to a region of the first, cased well bore to be intersected, arranging a mill guiding device in the second well bore near a casing coupling of a casing of the first, cased well bore, inserting a milling assembly into the second well bore, guiding the milling assembly along the mill guiding device and operating a mill of the mill assembly so that the mill first removes material from an upper surface of the casing coupling, and removing material from the casing coupling and the adjacent casing until the first, cased well bore and the second well bore are fluidly connected.

In another general aspect, a method for intersecting a first, cased well bore includes forming a second well bore that extends to a region of the first, cased well bore to be intersected, inserting a milling assembly into the second well bore, where the milling assembly has a mill guide, a mill, and a mill alignment device to align the mill and the mill guide as the mill advances along the mill guide, operating the mill and guiding the mill along the mill guide and into a casing of the first, cased well bore, and removing material from the casing until the first, cased well bore and the second well bore are fluidly connected.

In more specific aspects, the methods may further include removing the milling assembly from the second well bore.

The methods may further include inserting a plugging material into the first, cased well bore from the second well bore to form an obstruction. In some cases, the plugging material may include cement. In some cases, the obstruction limits an amount of fluid that can pass through the first, cased well bore. In some cases, the fluid is a gas.

The methods may further include running and setting an anchor packer assembly in the second well bore below the mill guiding device.

Disposing the mill guiding device may include running and positioning the mill using a drill string.

The mill guiding device may include a wedge-like member that is arranged in the second well bore to force the mill towards the casing of the first well bore as the mill is inserted into the second well bore.

The milling assembly may include the mill guiding device and the mill guiding device may include a wedge-like mill guiding device that is arranged in the second well bore to force the mill towards the casing of the first well bore as the mill is inserted into the second well bore.

The mill may include a rotating drill bit. In some cases, the rotating drill bit may be powered hydraulically.

The methods may further include running and setting an anchor packer assembly in the second well bore below the mill guide.

The mill alignment device may include one or more grooved rails disposed longitudinally along the mill guiding device that force the mill towards the casing as the mill is inserted into the second well bore. The mill may include one or more tabs that are sized to slide within the grooved rails. In some cases, as the mill moves along the mill guide device, the grooved guide rails limit the extent to which the mill may move transverse to the longitudinal direction of the mill guide.

In another general aspect, a method for intersecting a first, cased well bore includes forming a second well bore that extends to a region of the first, cased well bore to be intersected, inserting a laser tool assembly into the second well bore and aligning the laser tool assembly with the region of the first, cased well bored to be obstructed, operating the laser tool assembly and forming an opening in a casing of the first, cased well bore, and removing material from the casing until the first, cased well bore and the second well bore are fluidly connected.

In more specific aspects, the method may further include removing the laser tool assembly from the second well bore.

The laser tool assembly may include a laser perforator having a laser beam generator that generates a laser beam, and a focusing array through which the laser beam passes.

In another general aspect, a system for intersecting a first, cased well bore includes a drilling assembly that is configured to drill a second well bore having a distal end proximal to the first, cased well bore, a milling assembly, and a mill guiding device. The drilling assembly includes a drill string, and a drill bit disposed at an end of the drill string. The milling assembly includes a mill drill string and a mill disposed at an end of the mill drill string, the mill having a mill drill bit that is configured to cut and remove material from a casing wall of the first, cased well bore. The mill guiding device is configured to direct the mill drill bit towards the casing wall of the first, cased well bore.

In more specific aspects, the system may further include a plugging material delivery device that is configured to deliver a plugging material into the first, cased well bore. In some cases, the plugging material may be cement.

The system may further include an anchor packer assembly that is configured to be disposed at the distal end of the second well bore.

The mill guiding device may include a wedge-like member.

In another general aspect, a system for intersecting a first, cased well bore includes a drilling assembly that is configured to drill a second well bore having a distal end proximal to a casing coupling of the first, cased well bore, a milling assembly, and a mill guiding device. The drilling assembly includes a drill string and a drill bit disposed at an end of the drill string. The milling assembly includes a mill drill string and a mill disposed at an end of the mill drill string, the mill having a mill drill bit that is configured to rest along a surface of a casing coupling of the first, cased well bore and cut and remove material from a casing wall of the first, cased well bore and the casing coupling of the first, cased well bore. The mill guiding device is configured to direct the mill drill bit towards the casing wall of the first, cased well bore.

In more specific aspects, the surface of the casing coupling is an upper, generally flat surface along which the mill drill bit can rest while beginning a cut into the casing wall.

The mill guiding device may include a wedge-like member.

The system may further include a plugging material delivery device that is configured to deliver a plugging material into the first, cased well bore. In some cases, the plugging material is cement.

The system may further include an anchor packer assembly that is configured to be disposed at the distal end of the second well bore.

In another general aspect, a system for intersecting a first, cased well bore includes a drilling assembly that is configured to drill a second well bore having a distal end proximal to the first, cased well bore, a milling assembly, and a mill guiding device. The drilling assembly includes a drill string and a drill bit disposed at an end of the drill string. The milling assembly includes a mill drill string and a mill disposed at an end of the mill drill string, the mill having a mill drill bit that is configured to cut and remove material from a casing wall of the first, cased well bore. The mill guiding device is configured to direct the mill drill bit towards the casing wall of the first, cased well bore, the mill guiding device comprising alignment features that are configured to limit the relative motion of the mill drill bit relative to the mill guiding device as the mill drill bit moves longitudinally along the mill guiding device.

In more specific aspects, the alignment features may include one of more grooved guide rails disposed longitudinally along the mill guiding device. The mill drill bit may include one or more tabs that are sized to slide within the grooved rails. In some cases, as the mill drill bit moves along the mill guiding device, the grooved guide rails limit the extent to which the mill drill bit can move transverse to the longitudinal direction of the mill guiding device.

The system may further include a plugging material delivery device that is configured to deliver a plugging material into the first, cased well bore. In some cases, the plugging material is cement.

The system may further include an anchor packer assembly that is configured to be disposed at the distal end of the second well bore.

The mill guiding device may be a wedge-like member.

In another general aspect, a system for intersecting a first, cased well bore includes a drilling assembly that is configured to drill a second well bore having a distal end proximal to the first, cased well bore, and a laser tool assembly. The drilling assembly includes a drill string and a drill bit disposed at an end of the drill string. The laser tool assembly includes a laser perforator that is configured to emit a laser cutting beam that can penetrate a casing wall of the first, cased well bore and form an opening between the first, cased well bored and the second well bore.

In more specific aspects, the system may further include a plugging material delivery device that is configured to deliver a plugging material into the first, cased well bore. In some cases, the plugging material is cement.

The laser tool assembly may further include a first, cased well bore detector. The first, cased well bore detector may include an ultrasonic tool that is configured to detect noise from fluid flow within the first, cased well bore.

The laser perforator may include a laser beam generator that generates the laser beam, and the laser tool assembly may include a focusing array through which the laser cutting beam passes.

The laser tool assembly may further include a laser alignment device that is configured to detect the orientation of the laser perforator relative to the casing wall. The laser alignment device may include a metal detector. The metal detector may include a magnetic sensor.

A portion of the second well bore, where the laser tool assembly will be positioned for emitting a laser cutting beam, is substantially parallel to the first, cased well bore.

Embodiments may include one or more of the following advantages.

Using the methods and systems described herein, a cased well bore can be intersected, and in some cases obstructed, more easily than some other intersection methods by reducing the likelihood that a mill cutting into a casing of the cased well bore will walk laterally along the casing during cutting.

In some embodiments, a mill cutting into a casing of the cased well bore can begin removing material from the casing in a more controlled manner by seating along a generally flat surface of a casing coupling.

In some embodiments, the cased well bore is more easily intersected by using a laser tool which can be used to cut material from the casing in a more controlled manner than some other intersection methods.

The details of one or more embodiments are set forth in the accompanying drawings and the description below. Other aspects, features, and advantages will be apparent from the description and drawings, and from the claims.

DESCRIPTION OF DRAWINGS

FIG. 4A is a side view of a milling assembly including a mill and whipstock.

FIG. 4B is a top view of the milling assembly of FIG. 4A.

FIG. 4C is a cross-section view of the milling assembly of FIG. 4A taken at Section C-C.

DETAILED DESCRIPTION

Well bores, such as those used to deliver oil or gas from wells within the earth are periodically abandoned, for example, once a suitable amount of oil or gas has been withdrawn from the well or in the event of a well bore blowout. In some cases, a well bore is filled with a material (e.g., plugged with cement) to stop or prevent oil or gas from being inadvertently expelled from the well bore.

Figure 1:
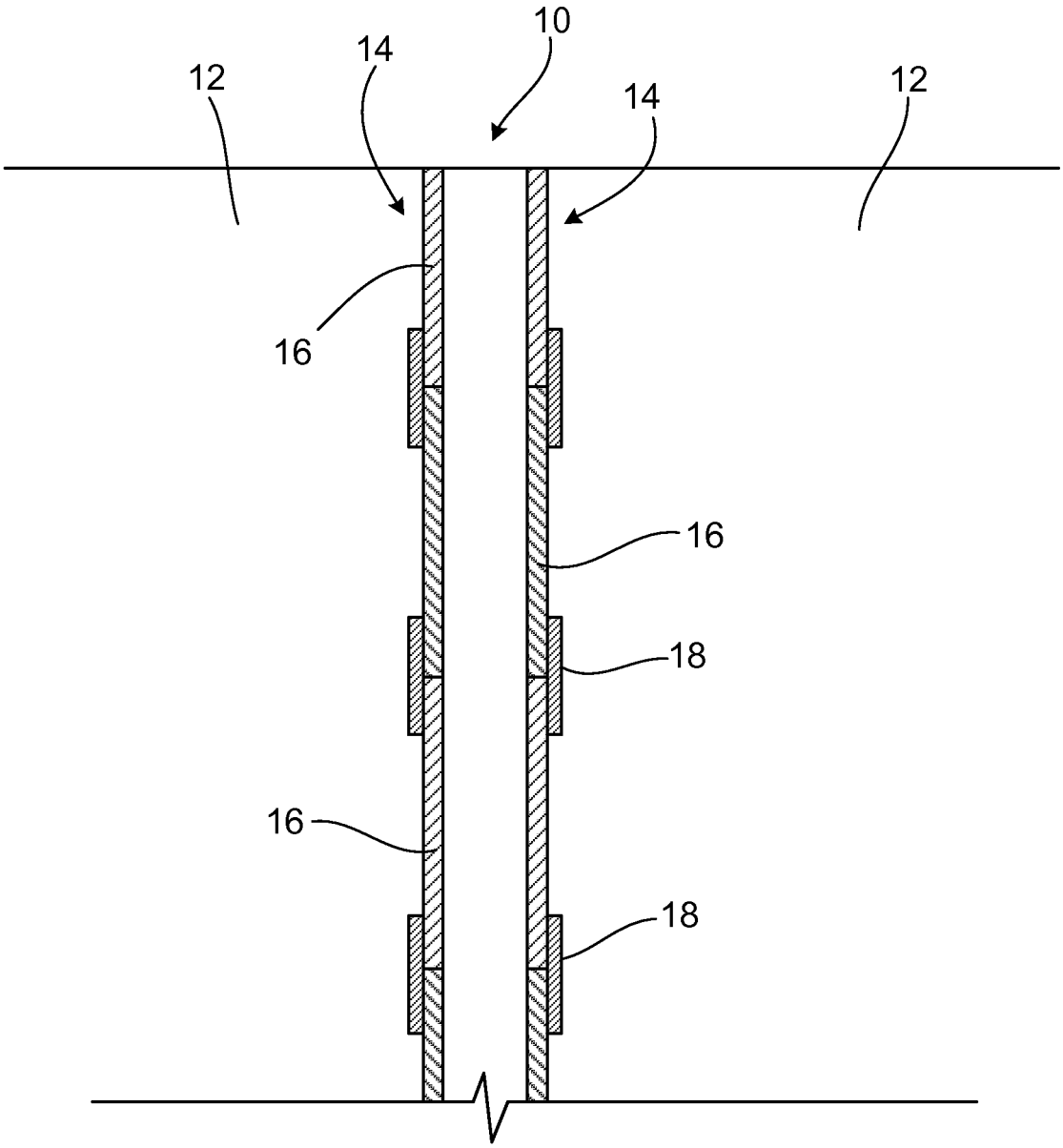
FIG. 1 illustrates a cross-sectional schematic diagram of a first, cased well bore.
Figure 2:
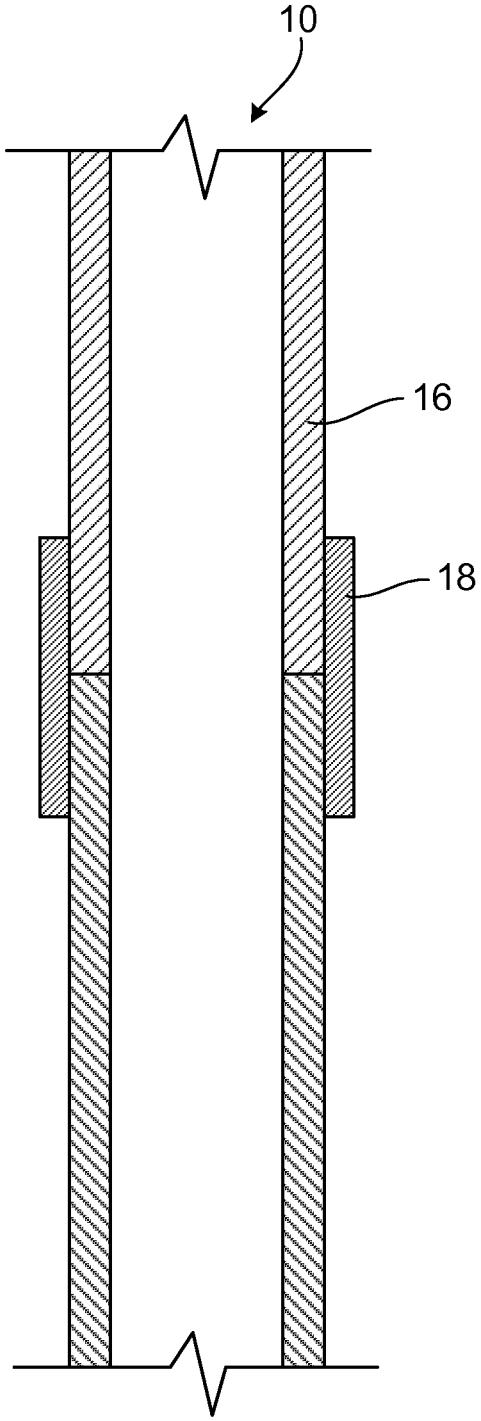
FIG. 2 illustrates an enlarged cross-sectional schematic diagram of the first well bore of FIG. 1 showing well bore casings connected by a casing coupling.

FIG. 1 illustrates a cross-sectional schematic diagram of a cased well bore (e.g., a first well bore) 10 arranged in a formation 12. For example, the first well bore 10 can be a well bore to be abandoned. The well bore 10 includes a casing 14 that adds structural integrity, as well acts as a conduit to deliver oil or gas from a well. As shown in FIG. 2, the casing 14 is typically made of multiple casing segments 16 that are connected by casing couplings 18. In some cases, it is necessary to penetrate the well bore to be abandoned in order to pump a filling material, such as cement, to form an obstruction and plug the well bore. The obstruction formed in the well bore limits oil or gas from being inadvertently expelled from the well bore. FIG. 2 illustrates an example region of the well bore 10 to be intersected near one of the casing couplings 18.

Figure 3A:
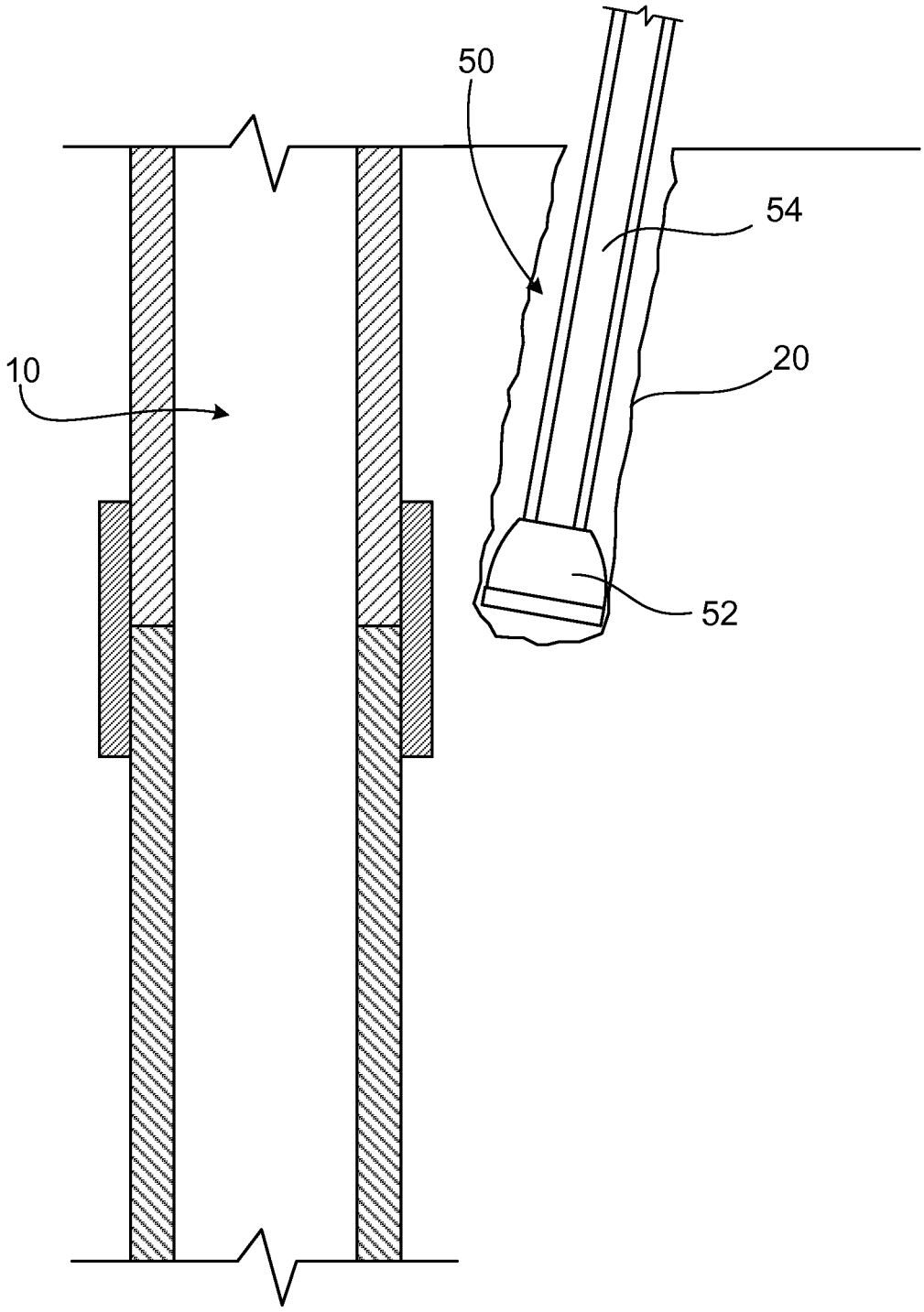
FIG. 3A illustrates a schematic diagram of an example milling assembly disposed in an second, intersecting well bore that is being drilled proximal to the first well bore of FIG. 1.

FIG. 3A illustrates a schematic diagram of an example drilling assembly 50 (e.g., having a drill bit 52 and drill string 54) forming an intersecting second well bore 20 adjacent to the first well bore 10 of FIG. 1. The intersecting well bore 20 is typically arranged at an angle of about 0 degrees to about 90 degrees (e.g., about 0 degrees to about 6 degrees, e.g., about 3 degrees) relative to the cased well bore 10 to be intersected.

The intersecting well bore 20 can be formed by any of various suitable conventional well bore drilling techniques. In some embodiments, a drill rig includes a series of drill string segments that have a drill bit attached to a distal end of the drill string. The drill bit drills (e.g., cuts) through subterranean geologic formations. Drilling fluid (e.g., drilling mud) is pumped down a bore inside of the drill pipe and exits through nozzles in the drill bit. Drilling mud can be a mixture of fluids, solids, and chemicals that are designed to have suitable physical and chemical characteristics to safely drill into the ground material and deliver removed material from the drilled well bore. For example, the drilling mud can be used to remove heat from the drill bit, to lift rock cuttings from the well bore to the surface, to reduce destabilization of the rock in the well bore walls, and to overcome the pressure of fluids inside the rock so that these fluids do not enter the well bore during drilling.

The rock cuttings generated during drilling are removed by the drilling mud as it circulates to surface outside of the drill string. The drilling mud can then be circulated through filters (e.g., shakers) that strain the rock cuttings from the drilling mud. The filtered drilling mud can then be returned to the well bore being drilled.

The drilling rig rotates the drill pipe at the surface and rotational torque is transmitted down the drill string to the bit. The bit is rotated and drills through the geologic formations. In other embodiments, the drill string is not rotated by the drilling rig but a down hole mud motor is installed at the distal end of the drill string and drilling mud is pumped down the drill string and passes through the down hole motor. The mud drives the motor as known in the art. The down hole motor provides rotational torque to the drill bit enabling the drill bit to drill through the formations. The drill bit is typically drilled through the formations and towards the first, cased well bore until it is within a desired distance away from the first well bore 10. Any of various suitable distance, depth, and/or location measurement techniques and devices can be used to monitor and control the position of the drill bit (i.e., and the profile of the intersecting well bore) relative to the first, cased well bore. For example, in some embodiments, sensors (e.g., magnetic sensors) arranged on or near the drill bit can detect the drill bit's proximity to a location through which the first, cased well bore is to be penetrated. The sensors are connected (e.g., wirelessly or via a wired connection) to a control unit of the drilling rig so that the trajectory of the drill bit can be properly controlled.

When the sensors determine that the drill bit is at a suitable position relative to the first well bore 10, the drilling rig can stop rotating the drill bit and withdraw the drill bit 52 and the drill string 54 from the newly formed second, intersecting well bore. A milling assembly is then connected to the lower end of the drill string and inserted into the second well bore 20 for penetrating the first cased well bore 10.

Figure 3B:
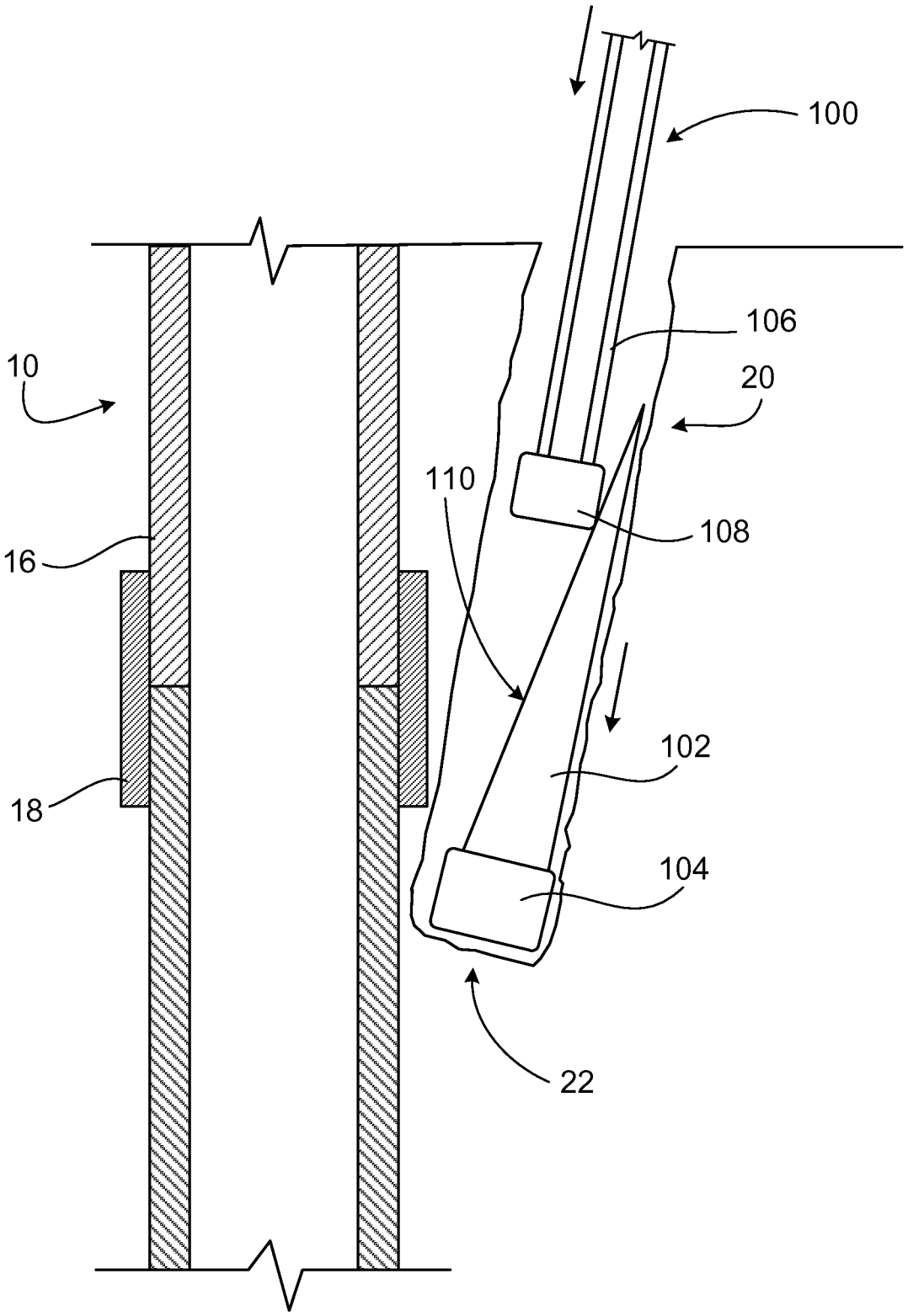
FIG. 3B illustrates a schematic diagram of the milling assembly of FIG. 3A anchoring a whipstock in the second well bore.

FIG. 3B illustrates a schematic diagram of a milling assembly 100 anchoring a mill guide (e.g., a whipstock) 102 and an anchor packer 104 into the intersecting well bore 20. The intersecting well bore 20 is formed so that its end 22 is proximal to one of the casing couplings 18 along the casing 16 of the first well bore 10.

The milling assembly 100 includes a drill string 106 that is connected to a mill 108 having a mill that is configured to, when operated, cut away material surrounding the mill 108. Like the drilling assembly 50, the drill string 106 can include a down hole mud motor installed at the distal end of the drill string 106 and drilling fluid (e.g., drilling mud) can be pumped down the drill string 106 and pass through the down hole motor. The drilling mud drives the down hole motor, as known in the art. The down hole motor provides rotational torque to the mill drill bit enabling the drill bit to drill through the formations 12 or the casing 16.

The anchor packer 104 and whipstock 102 are set into the intersecting well bore 20. For example, the anchor packer 104 and whipstock 102 are run into the intersecting well bore 20 on the distal end of the drill string 106 and may be connected to and positioned below the milling assembly 100.

The whipstock 102 is a wedge-like structure having an angled wedge-like surface 110 to create a taper within the intersecting well bore 20. In some embodiments, the whipstock 102 has a concave surface formed along the angled wedge-like surface 110 that is shaped to accommodate the outer diameter of the milling 108. The whipstock 102 is arranged within the intersecting well bore 20 so that the angled wedge-like surface 110 directs a mill 108 of the milling assembly 100 towards a portion of the cased well bore above a casing coupling 18. FIGS. 4A to 4C illustrate a milling assembly 100 that includes a mill 108 on a hydraulic running tool log and a whipstock 102.

Figure 4D:
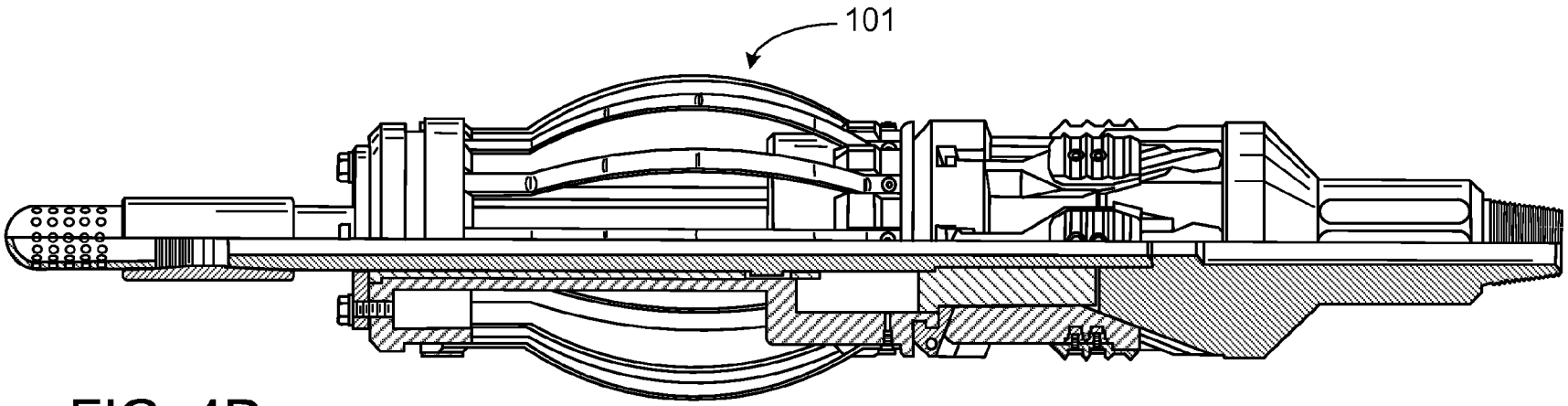
FIG. 4D is an open hole anchor assembly.
Figure 4E:
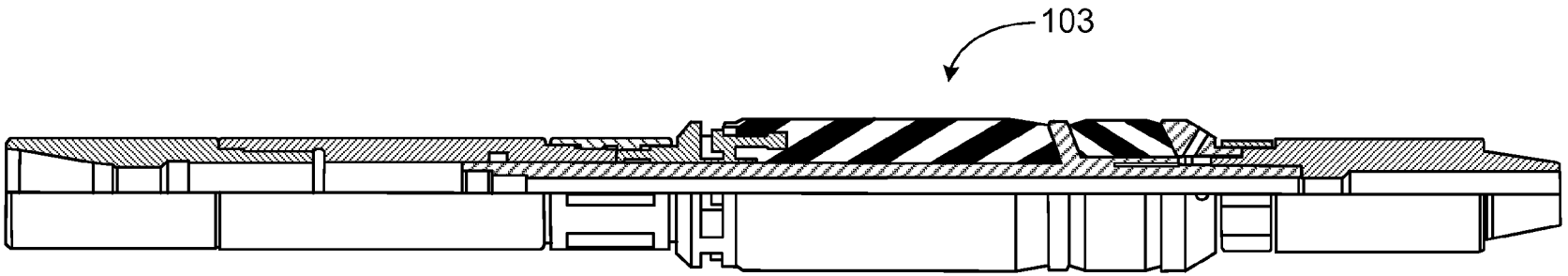
FIG. 4E is an open hole packer assembly.
Figure 4F:
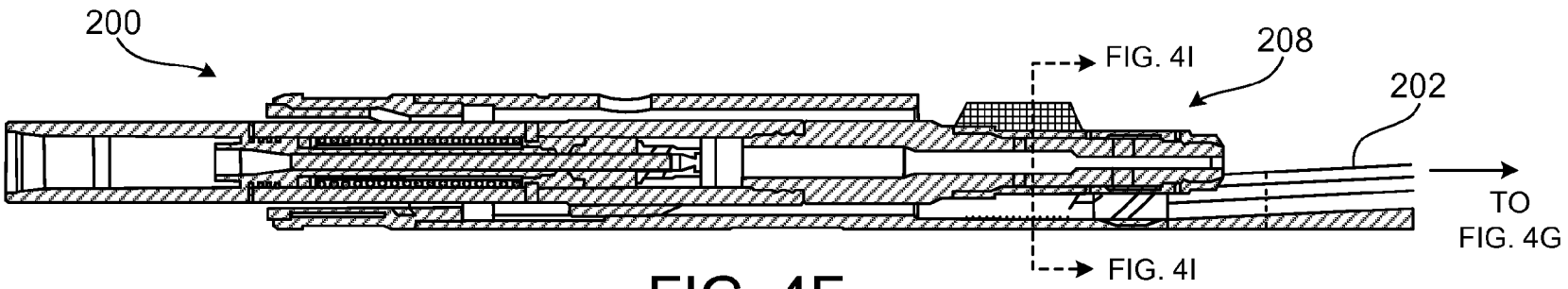
FIGS. 4F and 4G are cross-sectional side views, shown in segments, of an exemplary milling assembly.
Figure 4G:
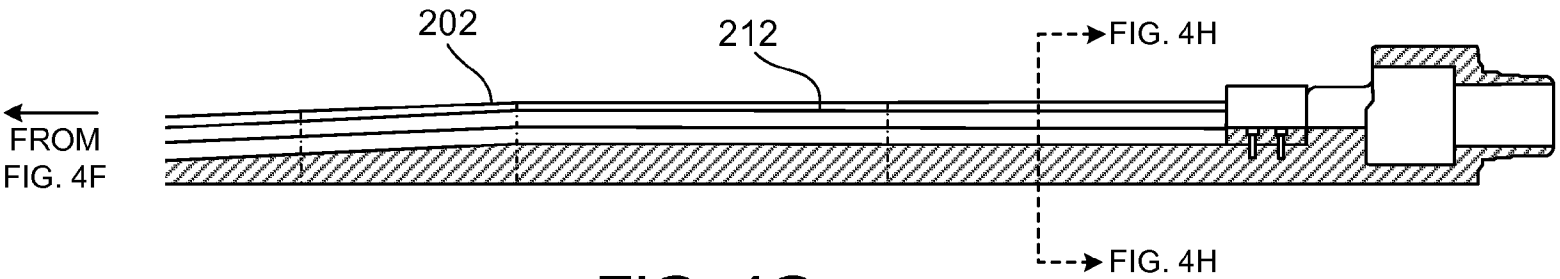
Figure 4I:
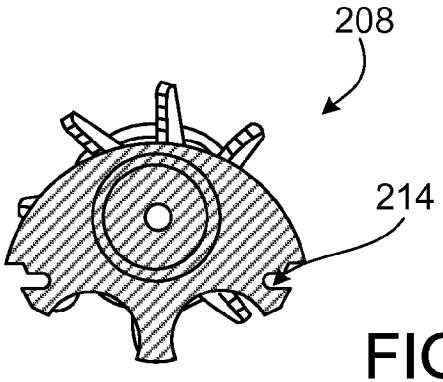
FIG. 4I is a cross-sectional front view of a mill of the milling assembly of FIG. 4A.
Figure 4H:
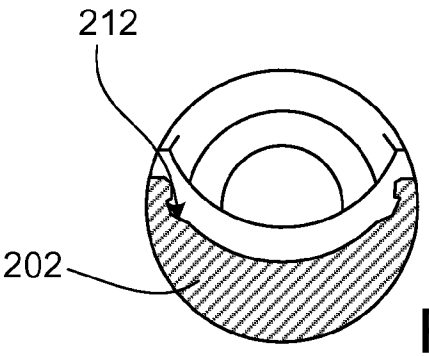
FIG. 4H is a cross-sectional front view of a milling guide of the milling assembly of FIG. 4A.

The anchor packer 104 and whipstock 102 are typically positioned into (e.g., run into) the intersecting well bore 20 as an assembly that is released from the drill string 106 once the anchor packer 104 contacts a surface, such as the end 22 of the intersecting well bore 20. Once released, the anchor packer 104 is expanded and contacts the walls of the ground surrounding the intersecting well bore 20 to provide structural stability to the anchor packer 104 and the whipstock 102. In some embodiments, the anchor packer 104 and the whipstock 102 are each run into the intersecting well bore 20 individually on separate trips of the drill string. In some embodiments, the anchor packer 104 is an anchor assembly 101 and a packer assembly 103. FIG. 4D illustrates an open hole anchor 101 available from Halliburton under model no. 635.69. FIG. 4E illustrates an open hole packer 103 available from Halliburton as model no. 630.345.

Figure 3C:
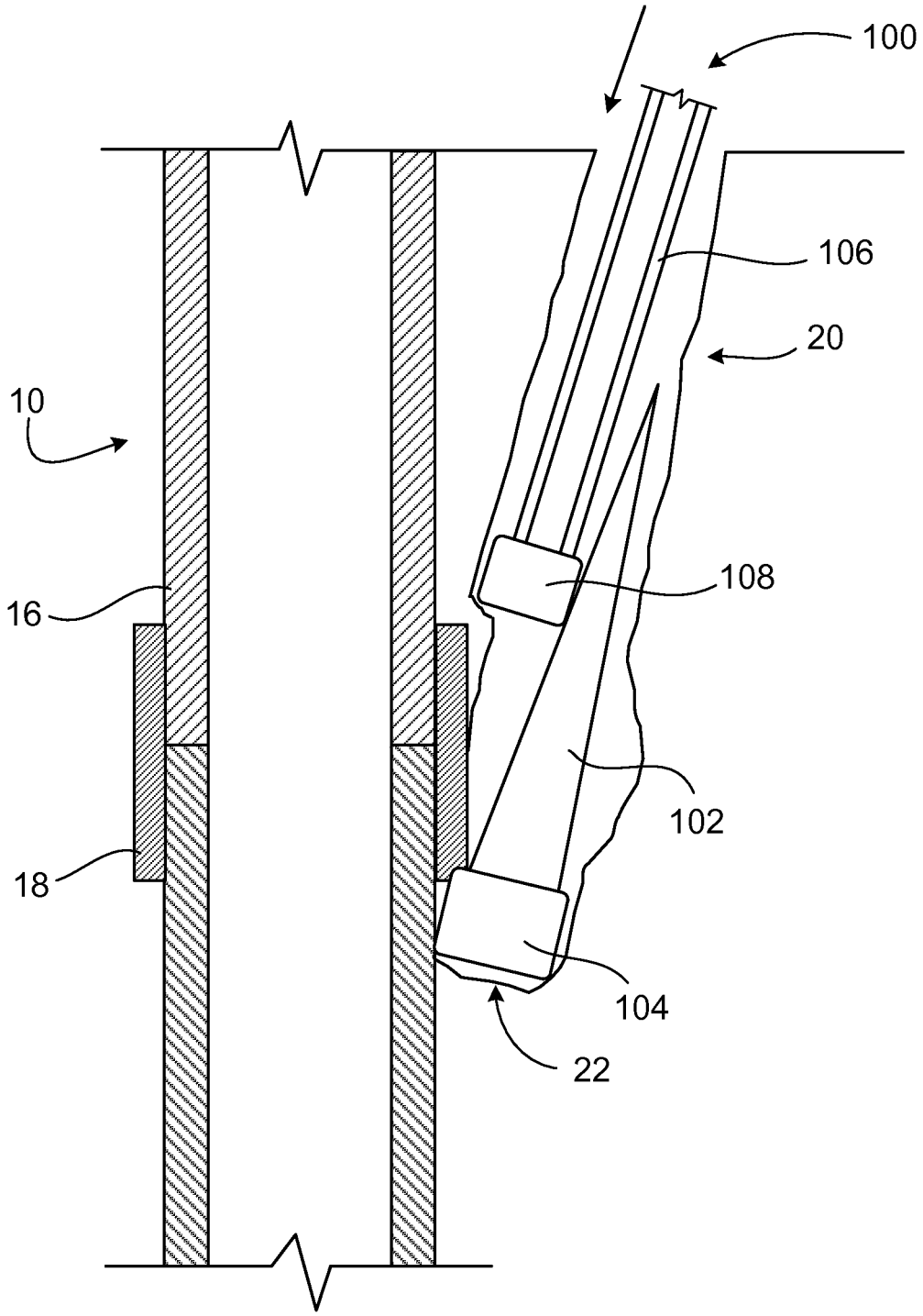
FIG. 3C illustrates a schematic diagram of a mill of the milling assembly of FIG. 3A released from the whipstock.

FIG. 3C illustrates a schematic diagram of a mill 108 of the milling assembly 100 of FIG. 3B released from the whipstock 102. Once the anchor packer 104 is set into the intersecting well bore 20, the milling assembly 100 (e.g., the mill 108 of the milling assembly 100) is released from the whipstock 102.

Typically, the mill 108 is connected to the whipstock 102 by connecting bolts that can be sheared due to axial force applied to the drill string 106 or due to torque applied to rotate the mill 108 and shear the connecting bolts. Once disconnected from the whipstock 102, the mill 108 can be rotated. For example, hydraulic drilling fluid (e.g., drilling mud) is pumped down the drill string 106 which drives a down hole motor that provides rotational torque to the mill 108 to begin cutting into the formation 12 between the intersecting well bore 20 and the cased well bore 10 and, due to the orientation of the whipstock 102, the mill 108 is directed towards the cased well bore 10. When the mill 108 is proximal to the casing 16 of the cased well bore 10, the mill 108 may drill though a cement sheath surrounding the casing 16 in the first well bore 10 (i.e., if the casing 16 has been cemented into the cased well bore 10). After milling though the cement sheath the mill 108 will contact the casing 16 of the cased well bore 10.

Figure 3D:
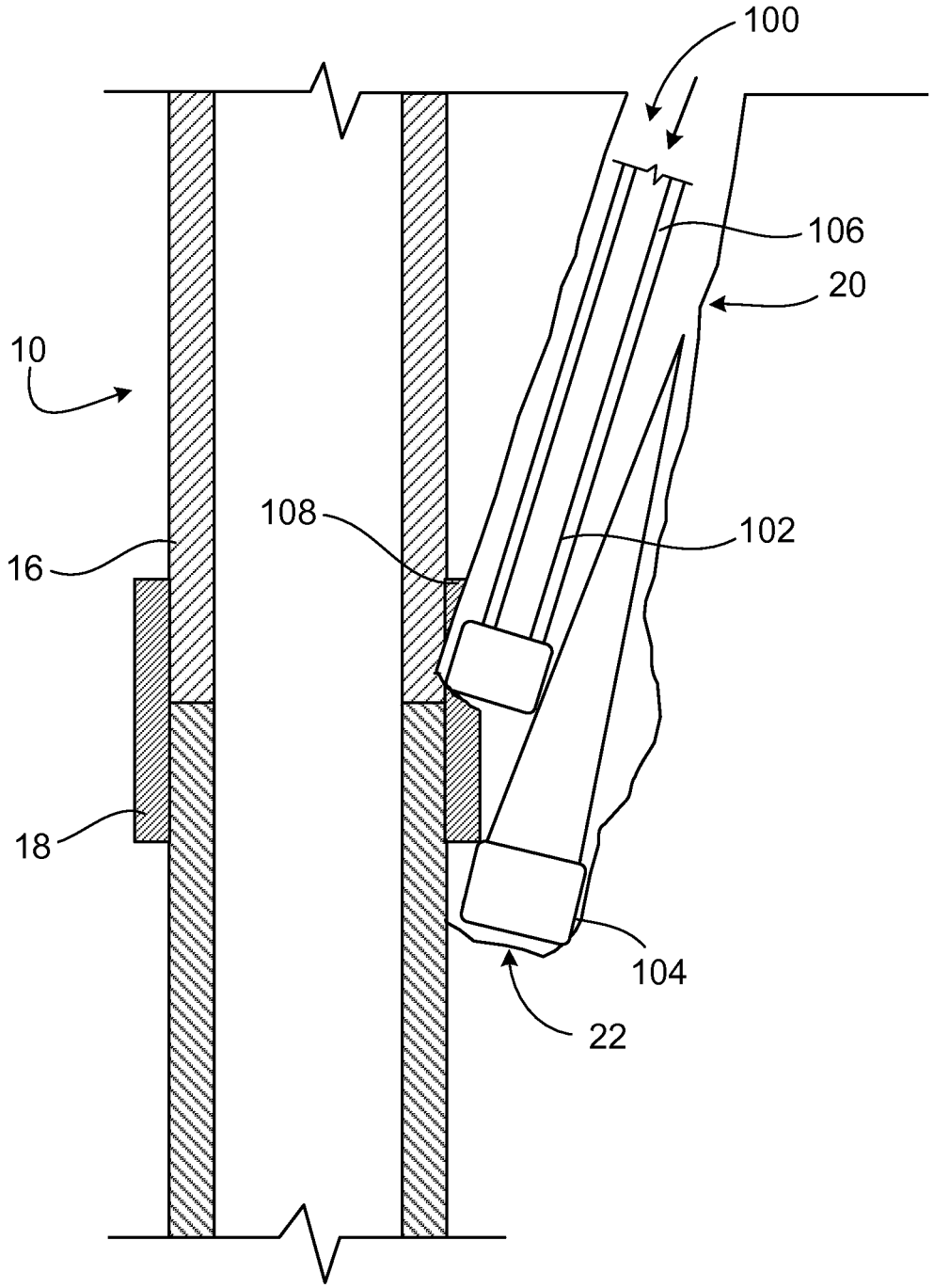
FIG. 3D illustrates a schematic diagram of the mill of FIG. 3C disposed in a second well bore wherein the mill is seated on a well bore casing coupling and is milling a hole in the casing wall above and through the casing collar of the first well bore.

FIG. 3D illustrates a schematic diagram of the mill 108 of FIG. 3C milling a well bore casing 16 above the casing coupling 18. Due to the arrangement of the intersecting well bore 20 and the set anchor packer 104 and whipstock 102, the mill 108 rides on an upper end of the casing collar 18 and cuts away the casing 16 above the collar 18 and begins to also cut away the collar 18. The relatively flat upper surface of the collar 18 provides an engaging surface that the mill 108 is able to begin cutting from. The mill 108 will preferentially cut into the casing wall 16 above the collar 18 and also cut collar. The whipstock 102, and its curved angular surface, also helps to guide the mill 108 and reduce the likelihood that the mill 108 will walk laterally along the outer surface of the casing 16.

Figure 3E:
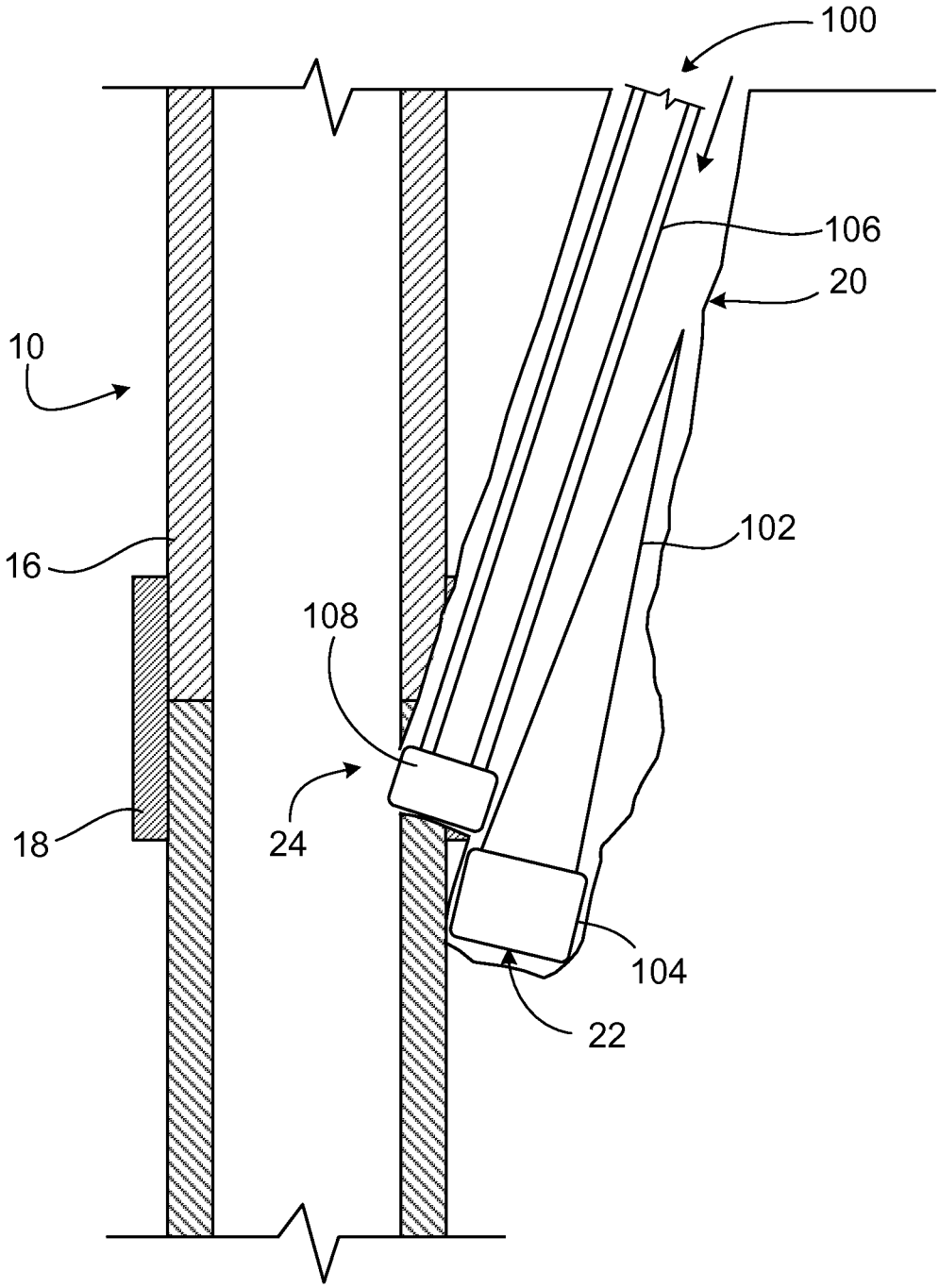
FIG. 3E illustrates a schematic diagram of the mill of FIG. 3C penetrating the casing wall and coupling of the first well bore of FIG. 3A and intersecting the first well bore of FIG. 3A.

FIG. 3E illustrates a schematic diagram of the mill 108 of FIG. 3C penetrating the well bore casing wall 16 and grinding off the upper portion of the coupling 18 of FIG. 3D and intersecting the cased well bore 10 of FIG. 3B. The mill 108 continues to operate and cuts through the casing wall 16 and the coupling 18 until it penetrates them to hydraulically connect the cased well bore 10 and the intersecting well bore 20.

The cutting path of the mill 108 within intersecting well bore 20 can depend on various factors, such as, for example, the size of the intersecting well bore 20, and the design and shape of the whipstock 102 and mill 108. For example, in some embodiments, depending on the desired size (e.g., the width) of the hole to be formed in the casing 16 being intersected and the taper angle of the inclined whipstock 102, the length of the cut can be estimated according to the following formula, $\mathrm{Tan}(x)=(w)/(2*L)$, where x is the taper angle of the whipstock (in degrees), w is the width of the mill 108 and L is the length of the cut. As shown, w is divided by 2 because the mill 108 would typically only need to travel a distance that is half of its diameter inward to fully penetrate the casing 16. In some implementations, the whipstock has a taper angle of 3 degrees (x=3 degrees). When forming holes using such whipstocks, if a mill with an 8.5 inch outer diameter is used, and therefore a hole that is generally a maximum of 8.5 inches wide would be formed in the casing 16 when the mill travels halfway into the casing then the length that the cut can be estimated by, $\mathrm{Tan}(3\ \mathrm{deg})=8.5/(2*L)$. The length, L, would be about 81 inches. Therefore, in order to fully penetrate the casing 16 and casing coupling 18, the mill 108 travels about 81 inches longitudinally while being driven into the casing by the whipstock 102.

The width and length of the cut to be formed in the casing 16 is generally determined based on the processes to be performed following intersection of the cased well bore 10. For example, in some cases, tubing or piping may be inserted into the cased well bore 10 to pump mud or cement into the cased well bore 10. In such cases, the width of the opening would likely be large enough to insert the tubing or piping, including a margin of error. Alternatively, in some cases, a long and wide enough opening is preferred to pump cement or mud directly into the intersecting well bore 20 in order to obstruct the cased well bore 10 without needing to insert tubing or piping directly into the cased well bore 10.

Typically, an opening is cut that has a greater flow area that the flow area of the tubing or piping used to pump the mud or cement so that the opening would not restrict the flow of the mud or cement being pumped. However, an even larger opening can be cut if needed, for example, if there was a need to insert something directly into the cased well bore 10 being intersected or to avoid a significant pressure loss through the opening if a large volume and/or high velocity of fluid is to be pumped through the opening.

While cutting, the mill 108 is rotates and cuts away the casing wall 16 and the casing coupling 18 until the cased well bore 10 is fully penetrated and a hole 24 is formed according to the desired hole parameters (as discussed above). Full penetration of the casing coupling 18 and the well bore casing wall 16 can be detected using any of various suitable techniques and devices. For example, the resisting torque at the mill 108 can be measured and monitored to predict (e.g., determine) the material through which the mill 108 is cutting. The resisting torque typically increases when the mill 108 begins cutting the metal casing wall 16 or casing coupling 18. Monitoring the amount the milling string advances (i.e., the depth of the milling string) from this point would give an indication of how wide an opening is being created.

Figure 3F:
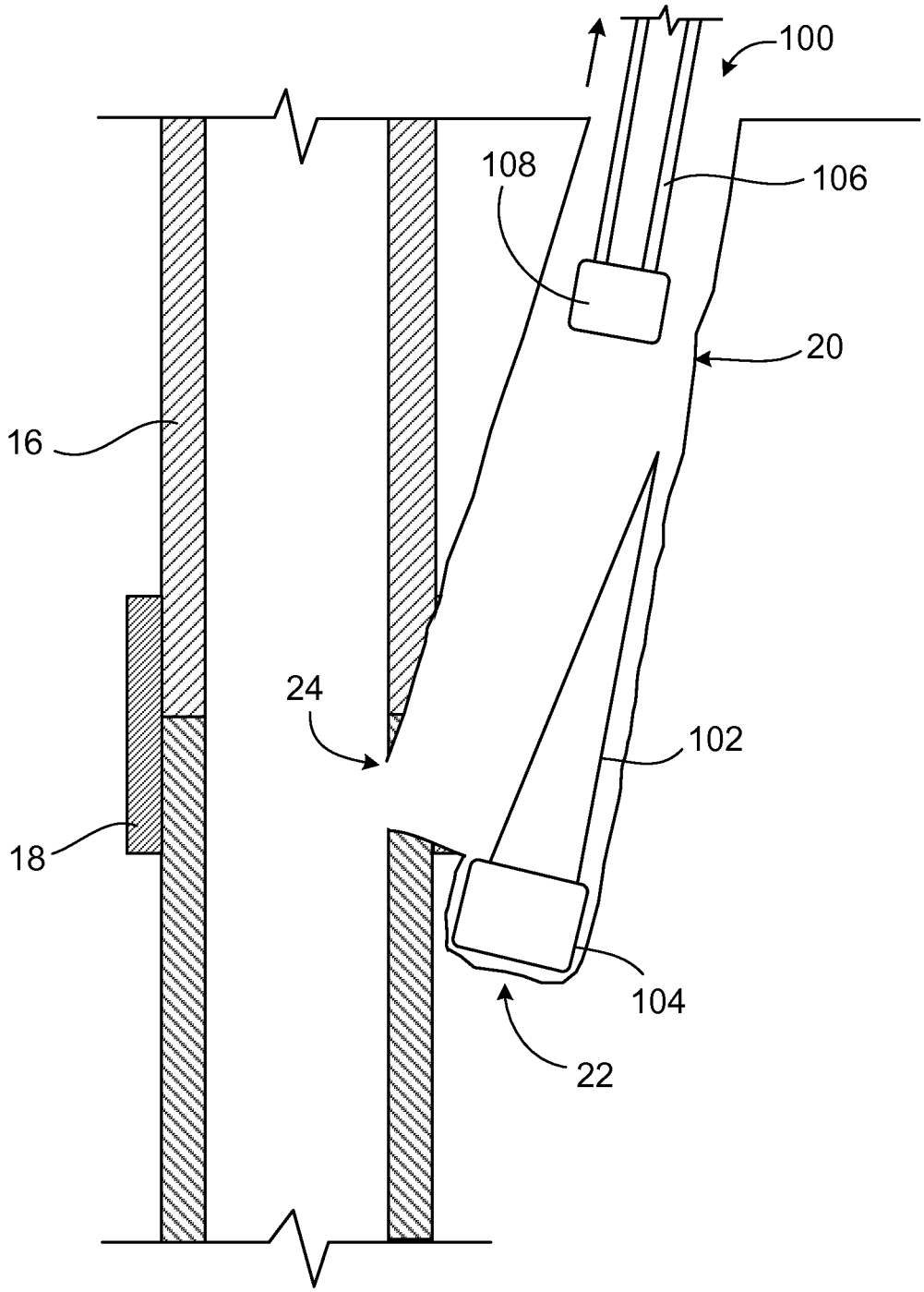
FIG. 3F illustrates the milling assembly of FIG. 3A being removed from the second well bore.

FIG. 3F illustrates the milling assembly 100 of FIG. 3B being removed from the intersecting well bore 20. The milling assembly 100 is removed from the intersecting well bore 20 so that a plugging material (e.g., cement) can be delivered from the intersecting well bore 20 through the penetrated hole 24 and into the cased well bore 10.

Typically, the anchor packer 104 and whipstock 102 are left in the intersecting well bore 20 during cement delivery. In some embodiments, the whipstock 102 and anchor packer 104 are removed prior to pumping cement.

Figure 3G:
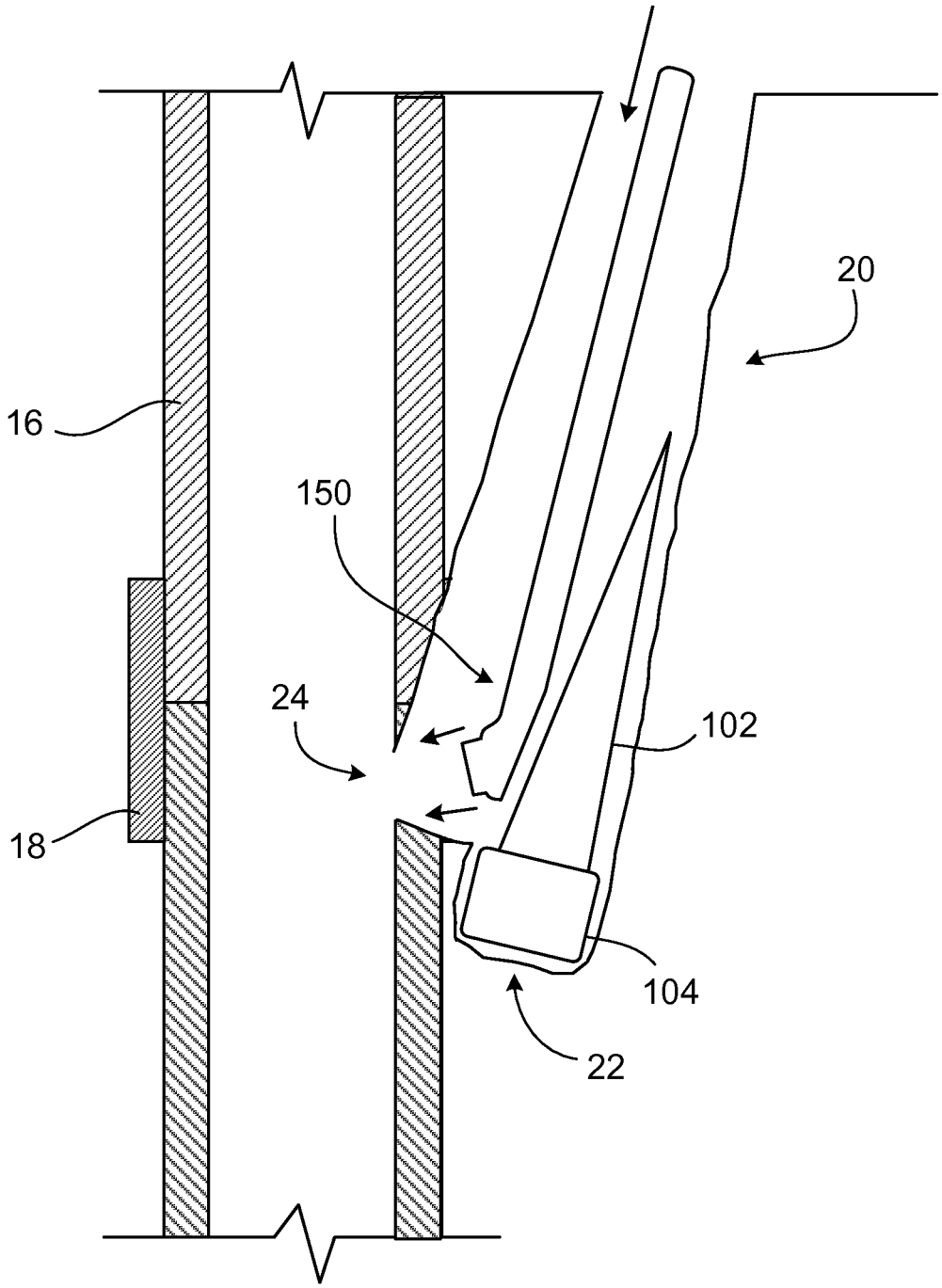
FIG. 3G illustrates a cement plugging assembly inserted into the second well bore and pumping a plugging material into the first well bore of FIG. 3A.

FIG. 3G illustrates a cement delivery assembly 150 inserted into the intersecting well 20 and pumping a plugging material (e.g., cement) into the cased well bore 10. Once the penetrated hole 24 is formed and the cased well bore 10 and the intersecting well bore 20 are fluidly connected, the cement delivery assembly 150 pumps cement into the cased well bore 10. For example, cement can be pumped from the intersecting well bore 20 through the penetrated hole 24 formed in the casing wall 16 and the coupling 18 and into the cased well bore 10.

Cement is pumped until an amount of cement that is sufficient for forming a structurally suitable barrier within the cased bore 10 is delivered. For example, in some cases, cement is pumped into the cased well bore 10 until a barrier is formed that can prevent a gas or oil from exiting the cased well bore 10. The volume of cement that is pumped is typically dependent upon the conditions of the well bore and, in some cases, regulatory requirements. In some embodiments, the cement delivery assembly 150 includes a check valve that permits cements to flow into the well bores while reducing the likelihood that fluid in either of the well bores (e.g., gas or oil) can flow upward in the drill string located in the intersecting well bore 20 and out of the intersecting well bore 20. For example, check valves can be used when intersecting and delivering cement to a well bore that has suffered a blowout. In some embodiments, cement is delivered using other systems. For example, cement can be pumped through the drill string 106 of the milling assembly 100.

In some embodiments, other types of equipment are used to deliver and guide a mill within the intersecting well bore 20. For example, milling assemblies can include alignment features to constrain the path of a mill along a mill guide. For example, referring to FIGS. 4F-4I, a milling assembly 200 can include a tapered mill guide 202 that engages with corresponding features of the mill 208 to help reduce the likelihood of the mill 208 from walking away from the mill guide 202, for example moving laterally along the well bore casing 16 of the cased well bore 10 during milling. For example, as shown, the MillRite style milling assembly 200 from Halliburton includes a mill guide 202 having alignment grooves 212 that span longitudinally along the mill guide 202 and help to align the mill 208 with the mill guide 202 and reduce the likelihood that the mill 208 will walk along the casing 16. The mill 208 includes tabs 214 that are sized and configured to be received within the grooves 212 of the mill guide 202.

The MillRite milling assembly 200 can be inserted into an intersecting well bore 20 until seated against the end 22 of the intersecting well bore 20 (e.g., using an anchor packer 104) (shown in FIG. 3B). Once in position near the cased well bore 20, hydraulic fluid (e.g., drilling mud) can be pumped down the drill string of the milling assembly 200, as discussed above with reference to FIGS. 3B-3E. Hydraulic pressure applied can be used to release a hydraulic mill 208 running tool from the mill guide 202 and the mill 208 can begin rotating and advancing along the wedge-like mill guide 202. Due the shape of the mill guide 202, the mill 208 slowly advances into and against the casing 16 of the cased well bore 10 and a hole can be cut that fluidly connects the cased well bore 10 and the intersecting well bore 20. Plugging material (e.g., cement) can then be inserted into the cased well bore 10 to obstruct the cased well bore 10, as discussed above and illustrated in FIG. 3G.

Laser Perforation

While mechanical machining devices have been described as forming the opening in the cased well bore 10, other techniques are possible.

Figure 5A:
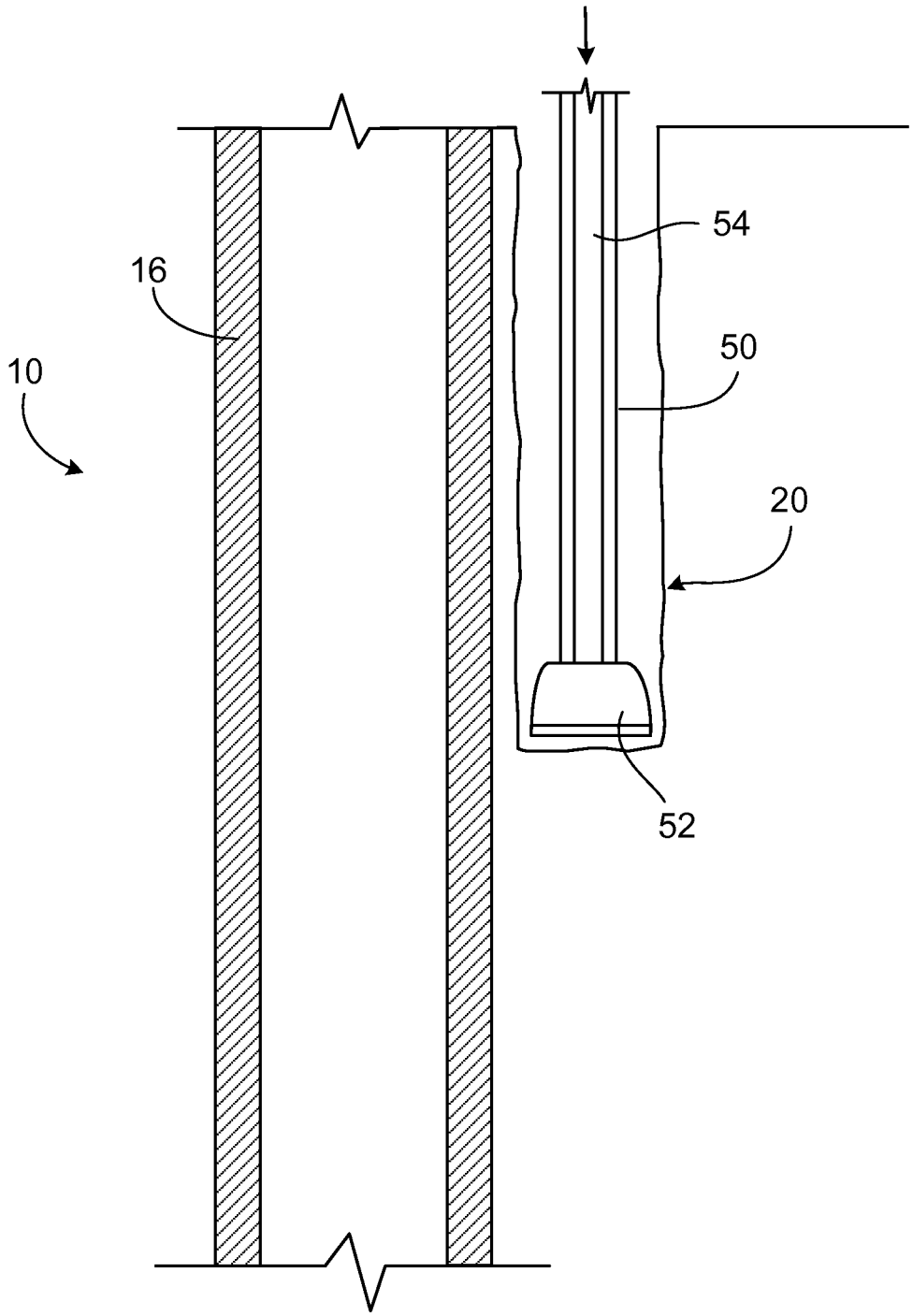
FIG. 5A illustrates a schematic diagram of an example of forming a second, adjacent well bore adjacent to the first, cased well bore of FIG. 1.

FIG. 5A illustrates a schematic diagram of an example drilling assembly 50 forming a second, adjacent well bore 20 proximal to the first, cased well bore 10 of FIG. 1. The drilling assembly 50 includes any of various suitable conventional drilling devices, such as the drilling rig discussed above. The adjacent well bore 20 is arranged so that a laser tool can be lowered downward generally vertically into the adjacent well bore 20. For example, the adjacent well bore 20 can be arranged relative to the cased well bore 10 so that a laser tool (e.g., a wireline laser tool) can be deployed at an angle of about 0 degrees to about 65 degrees relative to a vertically oriented cased well bore 10. The adjacent well bore 20 extends to a depth that at least reaches a desired location for penetrating the cased well bore 10. Once the adjacent well bore 20 is formed to the desired depth, the drilling assembly 50 (e.g., a drill bit 52 and drill string 54) can be raised and removed from the adjacent well bore 20.

Figure 5B:
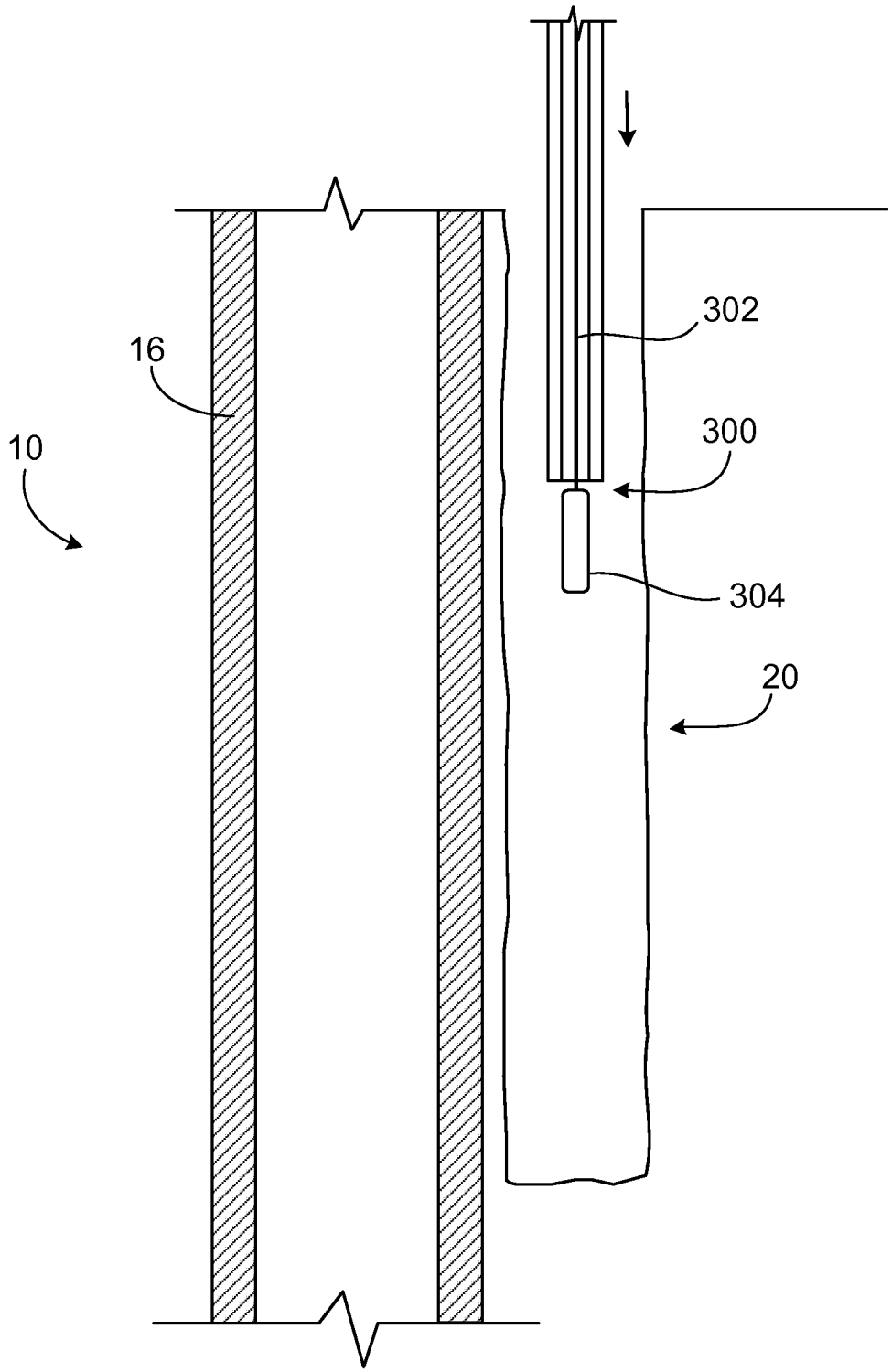
FIG. 5B illustrates a schematic diagram of a laser tool being lowered in the second well bore of FIG. 5A.
Figure 5C:
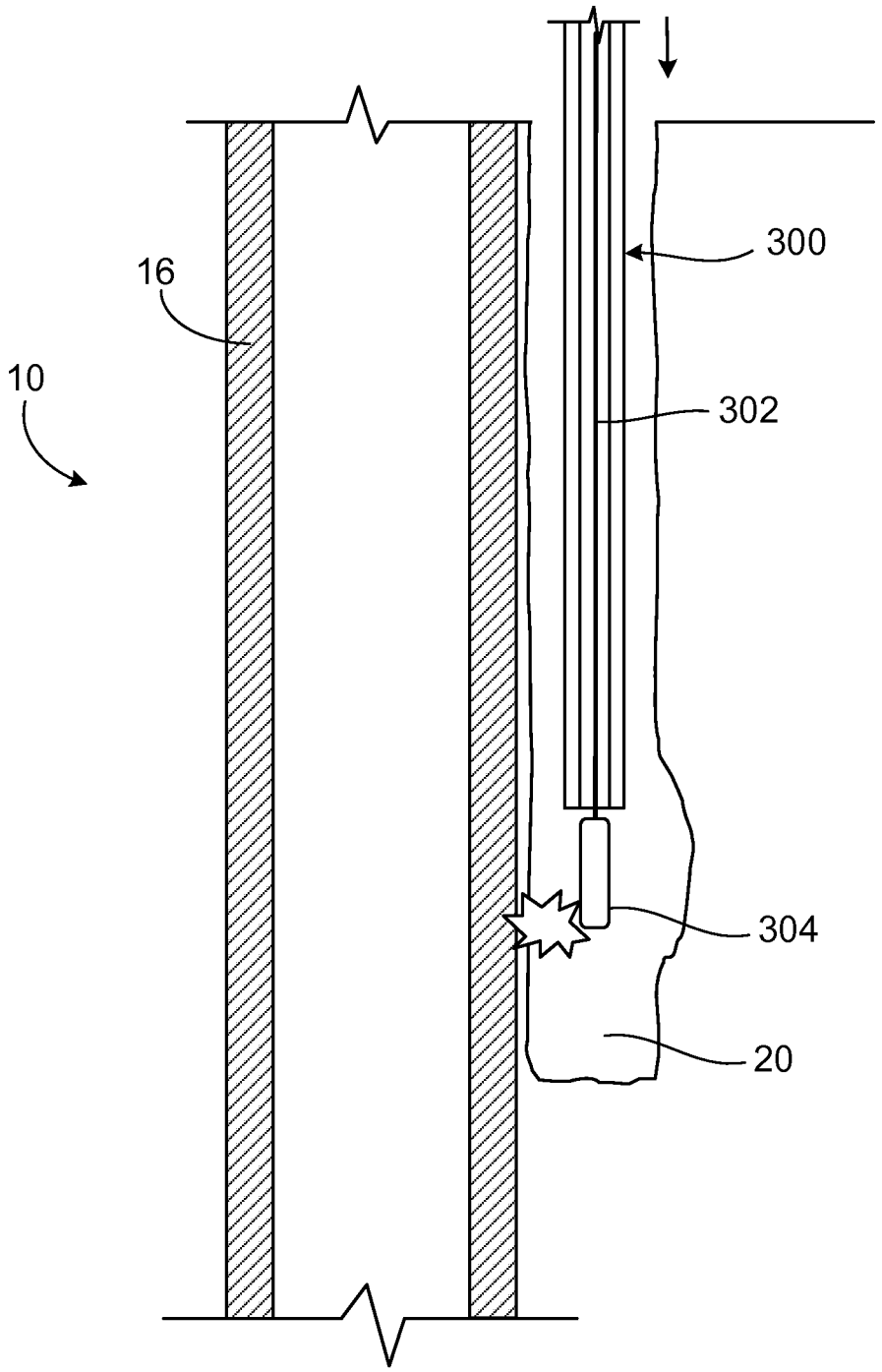
FIG. 5C illustrates the laser tool of FIG. 5B penetrating a casing of the first well bore of FIG. 1.

FIG. 5B illustrates a schematic diagram of a laser tool 300 being lowered in the adjacent well bore 20 of FIG. 4A. The laser tool 300 is lowered to the desired depth where a perforation in the casing of the cased well bore 10 is to be formed. Various techniques and devices can be used to determine the depth that the laser tool 300 has been lowered into the adjacent well bore 20. For example, a wire line measurement could be monitored as a cable 302 supporting the laser tool 300 is spooled off at the surface. However, in some cases, these measurements may have errors associated with stretching of the cable 302. In some embodiments, a magnetic ranging tool is used to detect the proximity of the laser tool 300 relative to the cased well bore 10. Alternatively or additionally, in some embodiments, the laser tool 300 includes an ultrasonic tool is arranged above a laser perforator 304, where the ultrasonic tool can detect the noise from the gas and/or fluid flow in the cased well bore 10 when the laser tool 300 reaches an area proximal to the cased well bore 10.

Once at the desired depth to form a perforation, the laser perforator 304 of the laser tool 300 is aligned with the casing 16 of the cased well bore 10. For example, the laser tool 300 can include metal detectors (e.g., magnetic sensors) so that as the laser tool 300 is rotated, it can detect when the laser perforator 304 is aimed at the metal casing 16. Alternatively or additionally, in some embodiments, ultrasonic tools are used to detect the orientation of the laser perforator 304 relative to the cased well bore 10 and for aiming the laser perforator 304 at the metal casing 16.

FIG. 4C illustrates a laser perforator 304 of the laser tool 300 of FIG. 4B penetrating the casing 16 of the cased well bore 10. Once aligned with the desired portion of the cased well bore 10, the laser of the laser perforator 304 can be operated to laser cut (e.g., perforate) an opening in the casing wall 16 of cased well bore 10. While the laser perforator 304 emits a laser cutting beam, the laser perforator 304 can be moved relative to the casing 16 to create an opening. Various devices can be used to move the laser perforator 304 and therefore also the emitted laser to form the opening. For example, hydraulic or electromechanical devices or system can be used to articulate the laser tool within the adjacent well bore to cut an opening. Prior art devices and systems that may be used to articulate a laser tool are disclosed in U.S. Pat. No. 7,938,175.

Once the opening is formed in the casing wall 16 of the cased wellbore 10, the laser tool 300 can be removed from the adjacent well bore 20. As discussed above, a cement pumping assembly can then be lowered down into the adjacent well bore 20 to the region of the opening formed along the casing wall 16 of the cased well bore 10 by the laser tool 300. Cement is then pumped from a cement pumping head of the cement pumping assembly into the opening. Cement is pumped until an amount of cement that is sufficient for forming a structurally suitable barrier within the cased well bore 10. For example, in some cases, cement is pumped into the cased well bore 10 until a barrier is formed that can prevent a gas or oil from exiting the cased well bore 10.

A number of embodiments have been described. Nevertheless, it will be understood that various modifications may be made without departing from the spirit and scope of the disclosure. Accordingly, other embodiments are within the scope of the following claims.

What is claimed is:

1. A method for intersecting a first, cased well bore, the method comprising:

forming a second well bore that extends to a region of the first, cased well bore to be intersected;

arranging a mill guiding device in the second well bore;

inserting a milling assembly into the second well bore;

guiding the milling assembly along the mill guiding device and contacting with a mill of the milling assembly an upper external shoulder of a casing coupling of a casing in the first, cased well bore;

operating the mill of the mill assembly so that the mill preferentially removes material from a convex portion of the casing above and adjacent to the upper external shoulder of the casing coupling; and removing material from the casing coupling and the adjacent casing until the first, cased well bore and the second well bore are fluidly connected.

2. The method according to claim 1, further comprising removing the milling assembly from the second well bore.

3. The method according to claim 1, further comprising inserting a plugging material into the first, cased well bore from the second well bore to form an obstruction.

4. The method according to claim 3, wherein the plugging material is cement.

5. The method according to claim 3, wherein the obstruction limits an amount of fluid that can pass through the first, cased well bore.

6. The method according to claim 3, further comprising running and setting an anchor packer in the second well bore below the mill guiding device.

7. The method according to claim 3, wherein the milling assembly comprises the mill guiding device and the mill guiding device is a wedge device that is arranged in the second well bore to force the mill towards the casing of the first well bore as the mill is inserted into the second well bore.

8. The method according to claim 3, wherein the mill comprises a rotating drill bit.

9. The method according to claim 8, wherein the rotating drill bit is powered hydraulically.

10. A method for intersecting a first, cased well bore, the method comprising:

forming a second well bore that extends to a region of the first, cased well bore to be intersected;

inserting a milling assembly into the second well bore, the milling assembly comprising a mill guide, a mill, and a mill alignment device to align the mill and the mill guide as the mill advances along the mill guide;

operating the mill and guiding the mill along the mill guide and contacting an upper external shoulder of a casing coupling of a casing of the first, cased well bore; and externally removing material from a convex portion of the casing above and adjacent to the casing coupling until the first, cased well bore and the second well bore are fluidly connected.

11. The method according to claim 10, further comprising removing the milling assembly from the second well bore.

12. The method according to claim 10, further comprising running and setting an anchor packer assembly in the second well bore below the mill guide.

13. The method according to claim 10, further comprising inserting a plugging material into the first, cased well bore from the second well bore to form an obstruction.

14. The method according to claim 13, wherein the plugging material is cement.

15. The method according to claim 13, wherein the obstruction limits an amount of fluid that can pass through the first, cased well bore.

16. The method according to claim 10, wherein the mill alignment device comprises one of more grooved guide rails disposed longitudinally along the mill guiding device that direct the mill towards an exterior surface of the casing of the first well bore as the mill is inserted into the second well bore.

17. The method according to claim 16, wherein the mill comprises one or more tabs that are sized to slide within the grooved guide rails.

18. The method according to claim 17, wherein, as the mill moves along the mill guide device, the grooved guide rails limit movement of the mill transverse to a longitudinal direction of the mill guide.

19. The method according to claim 10, wherein the mill comprises a rotating drill bit.

20. The method according to claim 19, wherein the rotating drill bit is powered hydraulically.

* * * * *